US009721491B2

(12) United States Patent
Pai

(10) Patent No.: US 9,721,491 B2
(45) Date of Patent: Aug. 1, 2017

(54) DISPLAY AND METHOD OF TRANSMITTING SIGNALS THEREIN

(71) Applicant: AU Optronics Corporation, Hsin-Chu (TW)

(72) Inventor: Cheng-Chiu Pai, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 301 days.

(21) Appl. No.: 14/033,590

(22) Filed: Sep. 23, 2013

(65) Prior Publication Data

US 2014/0267218 A1 Sep. 18, 2014

(30) Foreign Application Priority Data

Mar. 13, 2013 (TW) ..... 102108877 A

(51) Int. Cl.

| | |
|---|---|
| ***G09G 5/00*** | (2006.01) |
| ***G09G 3/20*** | (2006.01) |
| ***G09G 3/36*** | (2006.01) |

(52) U.S. Cl.

CPC ..... *G09G 3/20* (2013.01); *G09G 3/3614* (2013.01); *G09G 2310/0256* (2013.01); *G09G 2310/0275* (2013.01); *G09G 2310/0297* (2013.01); *G09G 2330/021* (2013.01)

(58) Field of Classification Search

CPC combination set(s) only.

See application file for complete search history.

(56) References Cited

U.S. PATENT DOCUMENTS 6,268,841 B1 * 7/2001 Cairns ..... G09G 3/2011 345/100
7,633,495 B2 12/2009 Lee et al.
2005/0200587 A1 9/2005 Hwang
(Continued)

FOREIGN PATENT DOCUMENTS

CN 1667689 9/2005

OTHER PUBLICATIONS

Phillip V. Lopresti, "ESE319 INtroduction to Microelectronics, CMOS Transmission Gates", Nov. 7, 2007.*
(Continued)

*Primary Examiner* — Benjamin C Lee
*Assistant Examiner* — Dong Hui Liang
(74) *Attorney, Agent, or Firm* — WPAT, PC

(57) ABSTRACT

A display includes first pixels, second pixels, a first de-multiplexer and a second de-multiplexer. The first de-multiplexer transmits a first data signal to the first pixels sequentially in response to first control signals. The second de-multiplexer transmits a second data signal to the second pixels sequentially in response to second control signals. The polarity of the first data signal is different from that of the second data signal. Levels of the first control signals are switched between a first voltage level and a zero voltage level, corresponding to the polarity of the first data signal. Levels of the second control signals are switched between a second voltage level and the zero voltage level, corresponding to the polarity of the second data signal. The first voltage level is different from the second voltage level. A method of transmitting signals in a display is also disclosed herein.

20 Claims, 9 Drawing Sheets

(56) References Cited

U.S. PATENT DOCUMENTS

| | | | | |
|---|---|---|---|---|
| 2006/0132420 | A1* | 6/2006 | Yoshida | G09G 3/2011 345/98 |
| 2009/0267932 | A1* | 10/2009 | Lin | G09G 3/3614 345/212 |
| 2014/0232626 | A1* | 8/2014 | Jamshidi-Roudbari | G09G 3/3688 345/92 |

OTHER PUBLICATIONS

Phillip V. Lopresti, "ESE 319 Introduction to Microelectronics, CMOS Transmission Gates", Nov. 7, 2007.*
"AN-31 Op Amp Circuit Collection", Sep. 2002.*
Wikipedia, "Transmission gate", last modified on Sep. 2, 2013, "http://en.wikipedia.org/wiki/Transmission_gate".

* cited by examiner

DISPLAY AND METHOD OF TRANSMITTING SIGNALS THEREIN

RELATED APPLICATIONS

This application claims priority to Taiwan Patent Application Serial Number 102108877, filed Mar. 13, 2013, which is herein incorporated by reference.

BACKGROUND

Technical Field

The present disclosure relates to a display. More particularly, the present disclosure relates to a de-multiplexer circuit in a display.

Description of Related Art

In recent years, since flat panel displays have characteristics such as high-quality image displaying capability and low consuming power, they have been commonly used as display apparatuses. Moreover, based on the consideration of manufacturing costs, multiplexer circuits and driving circuits (e.g., driving ICs) are usually disposed in a display panel of the display apparatus to cooperate with each other, such that transmission channels required by the driving circuits can be reduced, and sizes (or amounts) of the driving circuits can be decreased.

Conventionally, pixels in the display panel can be driven by different polarity inversions, and the multiplexer circuit alternately receives operation voltages with different polarities (e.g., alternate operation voltages of +5 V and −5 V) according to corresponding driving manners.

However, the aforementioned alternate operation voltages have a certain degree of voltage variations (or voltage differences), and thus when the multiplexer circuit operates, the operation power required by the multiplexer circuit according to the voltage variations would also increase correspondingly, to further cause the power loss required by the display panel to significantly increase as well. As a result, the consuming power required by the display apparatus would increase, and the performance of the display apparatus having low consuming power would be affected as well.

SUMMARY

An aspect of the present disclosure is related to a display. The display comprises a plurality of first pixels, a plurality of second pixels, a first de-multiplexer, and a second de-multiplexer. The first de-multiplexer is electrically coupled to the first pixels and configured to operate in response to a plurality of first control signals received by the first de-multiplexer to transmit a first data signal received by the first de-multiplexer to the first pixels sequentially. The second de-multiplexer is electrically coupled to the second pixels and configured to operate in response to a plurality of second control signals received by the second de-multiplexer to transmit a second data signal received by the second de-multiplexer to the second pixels sequentially. A polarity of the first data signal is different from a polarity of the second data signal. Levels of the first control signals switch between a first voltage level and a zero voltage level corresponding to the polarity of the first data signal, and levels of the second control signals switch between a second voltage level and the zero voltage level corresponding to the polarity of the second data signal. The first voltage level is different from the second voltage level.

Another aspect of the present disclosure is related to a display. The display comprises a plurality of first control lines, a plurality of first de-multiplexers, a plurality of second control lines, and a plurality of second de-multiplexers. Each of the first de-multiplexers is electrically coupled to the first control lines and configured to receive a plurality of first control signals through the first control lines to sequentially transmit a first data signal received by each of the first de-multiplexers to a plurality of first pixels electrically coupled to each of the first de-multiplexers in response to the first control signals. Each of the second de-multiplexers is electrically coupled to the second control lines and configured to receive a plurality of second control signals through the second control lines to sequentially transmit a second data signal received by each of the second de-multiplexers to a plurality of second pixels electrically coupled to each of the second de-multiplexers in response to the second control signals. A polarity of the first data signal is different from a polarity of the second data signal.

Yet another aspect of the present disclosure is related to a method of transmitting signals in a display. The display comprises a plurality of first pixels, a plurality of second pixels, a plurality of first control lines, a plurality of second control lines, a first de-multiplexer and a second de-multiplexer, in which the first de-multiplexer further comprises a plurality of first switch units, the second de-multiplexer further comprises a plurality of second switch units, the first control lines are configured to transmit a plurality of first control signals, and the second control lines are configured to transmit a plurality of second control signals. The method comprises the operations of: controlling the first switch units to switch on sequentially by the first control signals; transmitting a first data signal to the first pixels respectively through the first switch units which are switched on sequentially; controlling the second switch units to switch on sequentially by the second control signals; and transmitting a second data signal to the second pixels respectively through the second switch units which are switched on sequentially. The first control signals and the second control signals are synchronized and different from each other. Levels of the first control signals switch between a first voltage level and a reference voltage level corresponding to a polarity of the first data signal, and levels of the second control signals switch between a second voltage level and the reference voltage level corresponding to a polarity of the second data signal.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiments, with reference to the accompanying drawings as follows.

DESCRIPTION OF THE EMBODIMENTS

Figure 1:
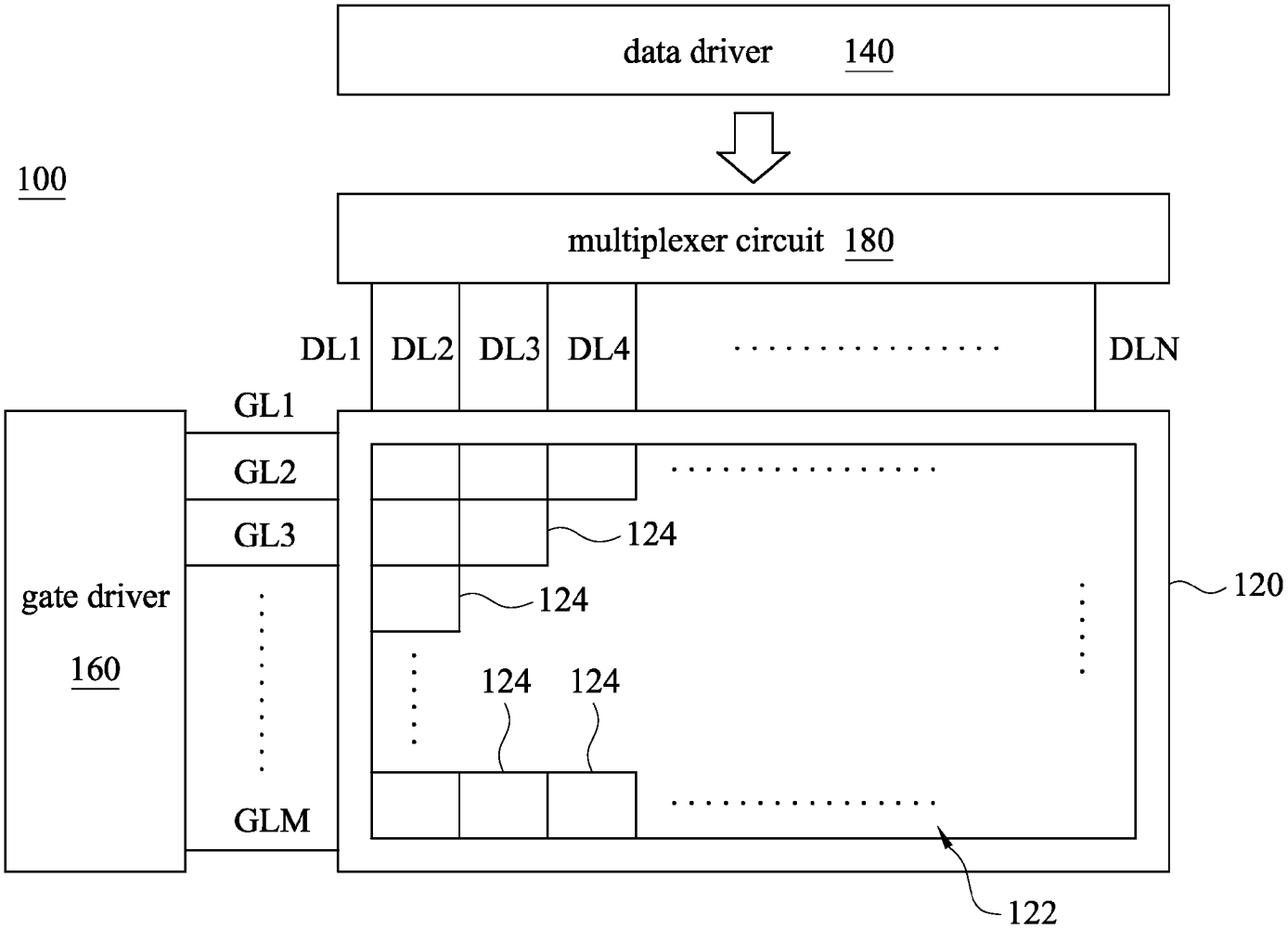
FIG. 1 is a schematic diagram of a display according to one embodiment of the present disclosure.

In the following description, specific details are presented to provide a thorough understanding of the embodiments of the present disclosure. Persons of ordinary skill in the art will recognize, however, that the present disclosure can be practiced without one or more of the specific details, or in combination with other components. Well-known implementations or operations are not shown or described in detail to avoid obscuring aspects of various embodiments of the present disclosure.

The terms used in this specification generally have their ordinary meanings in the art and in the specific context where each term is used. The use of examples anywhere in this specification, including examples of any terms discussed herein, is illustrative only, and in no way limits the scope and meaning of the disclosure or of any exemplified term. Likewise, the present disclosure is not limited to various embodiments given in this specification.

As used herein, "around", "about", "approximately" or "substantially" shall generally mean within 20 percent, preferably within 10 percent, and more preferably within 5 percent of a given value or range. Numerical quantities given herein are approximate, meaning that the term "around", "about", "approximately" or "substantially" can be inferred if not expressly stated, or meaning other approximate values.

It will be understood that, although the terms "first," "second," etc., may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

As used herein, the terms "comprising," "including," "having," "containing," "involving," and the like are to be understood to be open-ended, i.e., to mean including but not limited to.

Reference throughout the specification to "one embodiment" or "an embodiment" means that a particular feature, structure, implementation, or characteristic described in connection with the embodiment is included in at least one embodiment of the present disclosure. Thus, uses of the phrases "in one embodiment" or "in an embodiment" in various places throughout the specification are not necessarily all referring to the same embodiment. Furthermore, the particular features, structures, implementation, or characteristics may be combined in any suitable manner in one or more embodiments.

In the following description and claims, the terms "coupled" and "connected", along with their derivatives, may be used. In particular embodiments, "connected" and "coupled" may be used to indicate that two or more elements are in direct physical or electrical contact with each other, or may also mean that two or more elements may be in indirect contact with each other. "Coupled" and "connected" may still be used to indicate that two or more elements cooperate or interact with each other.

FIG. 1 is a schematic diagram of a display according to one embodiment of the present disclosure. As shown in FIG. 1, the display 100 includes an image displaying region 120, a data driver 140, a gate driver 160 and a multiplexer circuit 180. The image displaying region 120 includes display pixels 124 and a pixel array 122 which is formed by data lines (e.g., N data lines DL1-DLN) interlacing with scan lines (e.g., M scan lines GL1-GLM), and the display pixels 124 are disposed in the pixel array 122. The data driver 140 is electrically coupled to the multiplexer circuit 180 and electrically coupled through the multiplexer circuit 180 to the data lines DL1-DLN. The data driver 140 is configured to output data signals to the image displaying region 120 for the corresponding pixels 124 through the multiplexer circuit 180 and the data lines DL1-DLN. The gate driver 160 is electrically coupled to the scan lines GL1-GLM, and configured to output gate driving signals, through the scan lines GL1-GLM, for sequentially driving the corresponding pixels 124 in the image displaying region 120.

Figure 2:
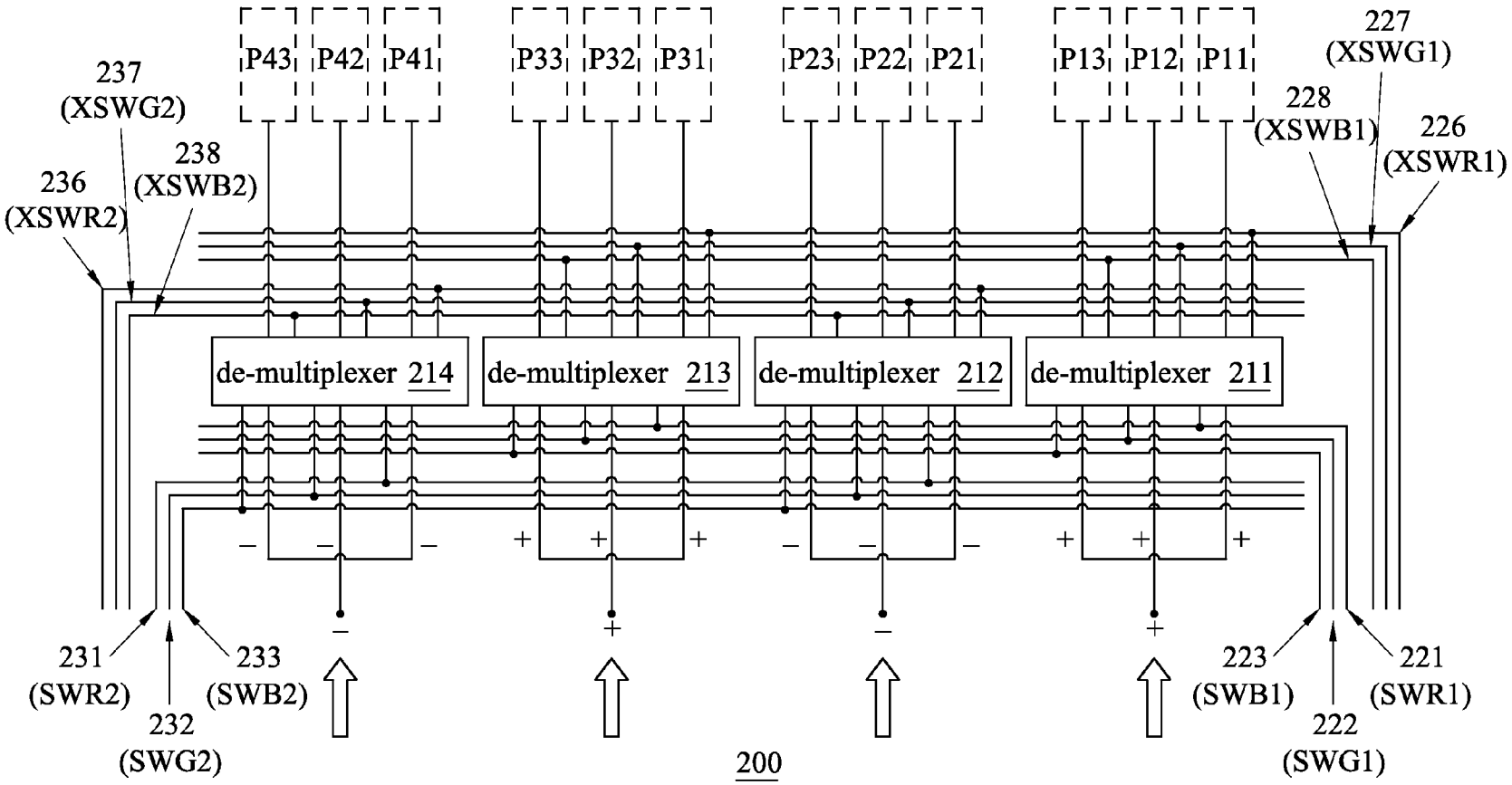
FIG. 2 is a schematic diagram of a multiplexer circuit according to a first embodiment of the present disclosure.

FIG. 2 is a schematic diagram of a multiplexer circuit according to a first embodiment of the present disclosure. The multiplexer circuit 200 shown in FIG. 2 can be applied in, but not limited to, the display 100 shown in FIG. 1. It needs to be explained that, although FIG. 2 merely illustrates a certain number of de-multiplexers, the configuration illustrated in FIG. 2 is exemplified for purposes of convenient illustration only, and not intended to be limiting of the present disclosure. In other words, persons of ordinary skill in the art can use a different number of de-multiplexers according to practical needs.

As illustrated in FIG. 2, the multiplexer circuit 200 includes a plurality of de-multiplexers (e.g., de-multiplexers 211-214) and a plurality of control lines (e.g., control lines 221-223, 231-233), in which the de-multiplexers are electrically coupled to the corresponding control lines and the pixels (e.g., pixels P11-P13, P21-P23, P31-P33, P41-P43) in the pixel array, respectively, and correspondingly receive the data signals outputted by the data driver.

Specifically, each of the de-multiplexers 211 and 213 is electrically coupled to the control lines 221-223 and correspondingly receives the data signal (e.g., a positive polarity data signal), and each of the de-multiplexers 212 and 214 is electrically coupled to the control lines 231-233 and correspondingly receives the data signal (e.g., a negative polarity data signal). The control lines 221-223 are configured to transmit control signals SWR1, SWG1, SWB1, respectively, and the control lines 231-233 are configured to transmit control signals SWR2, SWG2, SWB2, respectively. Moreover, the de-multiplexer 211 is electrically coupled to the pixels P11-P13, the de-multiplexer 213 is electrically coupled to the pixels P31-P33, the de-multiplexer 212 is electrically coupled to the pixels P21-P23, and the de-multiplexer 214 is electrically coupled to the pixels P41-P43. In one embodiment, the pixels P11-P13 and P31-P33 can be sub-pixels of the odd pixels, and the pixels P21-P23 and P41-P43 can be sub-pixels of the even pixels.

Each of the de-multiplexers 211 and 213 is configured to receive the control signals SWR1, SWG1, SWB1 from the control lines 221-223. The de-multiplexers 211 and 213 are configured to sequentially transmit the received data signals (e.g., the positive polarity data signals) to the coupled pixels (e.g., the pixels P11-P13, P31-P33), in response to the control signals SWR1, SWG1, and SWB1. Each of the de-multiplexers 212 and 214 is configured to receive the control signals SWR2, SWG2, SWB2 from the control lines 231-233. The de-multiplexers 212 and 214 are configured to sequentially transmit the received data signals (e.g., the negative polarity data signals) to the coupled pixels (e.g., the pixels P21-P23, P41-P43), in response to the control signals SWR2, SWG2, and SWB2. The polarity of the data signals received by the de-multiplexers 211 and 213 is different from those of the data signals received by the de-multiplexers 212 and 214. For example, the de-multiplexers 211 and 213 receive the positive polarity (or the negative polarity) data signals, and the de-multiplexers 212 and 214 receive the negative polarity (or the positive polarity) data signals. Illustratively, the de-multiplexers controlled by each control line receive the data signals having the same polarity, so voltage levels of the control signals transmitted by each control line can have a smaller variation range (e.g., the control signals vary in the range of 0 V-5 V according to the positive polarity data signals, or the control signals vary in the range of −5 V-0 V according to the negative polarity data signals).

In one embodiment, the levels of the control signals SWR1, SWG1, SWB1 switch, corresponding to the polarity of the data signals received by the de-multiplexers 211 and 213, between a first voltage level and a reference voltage level (e.g., a zero voltage level), and the levels of the control signals SWR2, SWG2, SWB2 switch, corresponding to the polarity of the data signals received by the de-multiplexers 212 and 214, between a second voltage level and the reference voltage level (e.g., the zero voltage level), and the first voltage level is different from the second voltage level.

Figure 3:
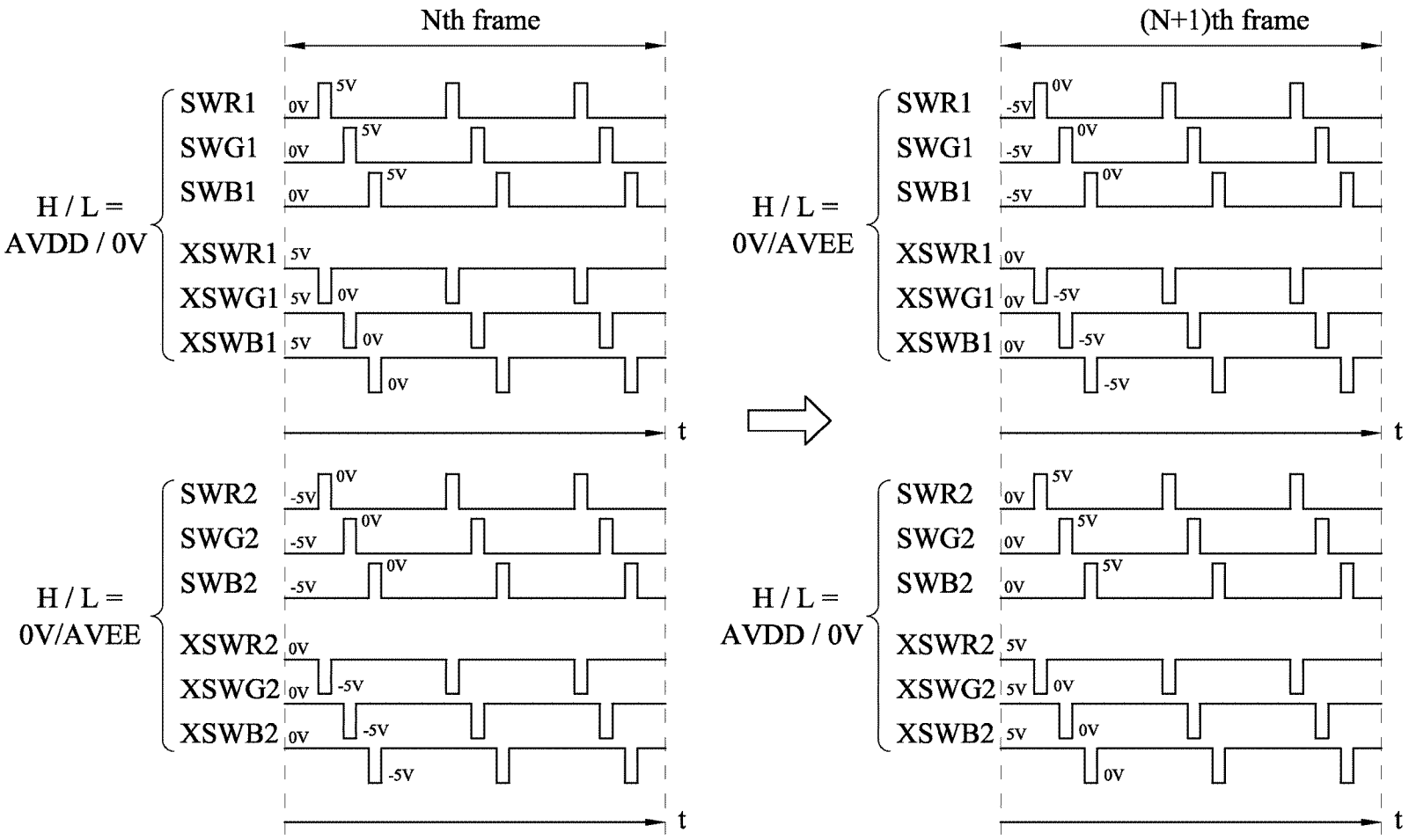
FIG. 3 illustrates a clock diagram of the control signals for the multiplexer circuit as shown in FIG. 2.

FIG. 3 illustrates a clock diagram of the control signals for the multiplexer circuit as shown in FIG. 2. For example, as shown in FIG. 3, in a condition of displaying the N-th frame, if the de-multiplexers 211 and 213 receive the positive polarity data signals (e.g., the signals having a level of 0 V-GVDD) and the de-multiplexers 212 and 214 receive the negative polarity data signals (e.g., the signals having a level of −GVDD-0 V), the levels of the control signals SWR1, SWG1, SWB1 switch between a low voltage level AVEE (e.g., −5 V) and a high level of zero voltage. In addition, in a condition of displaying the (N+1)-th frame, if the de-multiplexers 211 and 213 receive the negative polarity data signals (e.g., the signals having the level of −GVDD-0 V) and the de-multiplexers 212 and 214 receive the negative polarity data signals (e.g., the signals having the level of 0 V-GVDD), the levels of the control signals SWR1, SWG1, SWB1 switch between the low voltage level AVEE (e.g., −5 V) and the high level of zero voltage.

In one embodiment, the control signals SWR1, SWG1, SWB1 are synchronized with and different from the control signals SWR2, SWG2, SWB2, respectively. In other words, as shown in FIG. 3, the control signals SWR1, SWG1, SWB1 are generated sequentially and the levels thereof are switched between 0-AVDD (or AVEE-0), and the control signals SWR2, SWG2, SWB2 are generated in synchronous with the control signals SWR1, SWG1, SWB1, respectively, and the levels thereof are switched between AVEE-0 (or 0-AVDD) and different from those of the control signals SWR1, SWG1, SWB1.

In another embodiment, the polarity of the control signals SWR1, SWG1, SWB1 is different from that of the data signals received by the de-multiplexers 211 and 213, and the polarity of the control signals SWR2, SWG2, SWB2 is different from that of the data signals received by the de-multiplexers 212 and 214. Specifically, when the de-multiplexers 211 and 213 receive the positive or negative polarity data signal, the control signals SWR1, SWG1, SWB1 correspondingly have the positive polarity (e.g., the levels are switched between 0-AVDD) or negative polarity (e.g., the levels are switched between AVEE-0). Similarly, when the de-multiplexers 212 and 214 receive the negative or positive polarity data signal, the control signals SWR2, SWG2, SWB2 correspondingly have the negative polarity (e.g., the levels are switched between AVEE-0) or positive polarity (e.g., the levels are switched between 0-AVDD).

In addition, in yet another embodiment, as shown in FIG. 2, the multiplexer circuit 200 may further include control lines 226-228 and 236-238. Each of the de-multiplexers 211 and 213 is further electrically coupled to the control lines 226-228, and each of the de-multiplexers 212 and 214 is further electrically coupled to the control lines 236-238, in which the control lines 226-228 are configured for transmitting control signals XSWR1, XSWG1, XSWB1, respectively, and the control lines 236-238 are configured for transmitting control signals XSWR2, XSWG2, XSWB2, respectively. In one embodiment, the control signals SWR1, SWG1, SWB1 are synchronized with the control signals XSWR1, XSWG1, XSWB1, respectively, and the control signals SWR2, SWG2, SWB2 are synchronized with the control signals XSWR2, XSWG2, XSWB2, respectively.

Moreover, each of the de-multiplexers 211 and 213 is configured for receiving the control signals SWR1, SWG1, SWB1, XSWR1, XSWG1, XSWB1, and transmits the received data signals sequentially to the coupled pixels in response to these control signals. Each of the de-multiplexers 212 and 214 is configured for receiving the control signals SWR2, SWG2, SWB2, XSWR2, XSWG2, XSWB2, and transmits the received data signals sequentially to the coupled pixels in response to these control signals.

In one embodiment, the levels of the control signals XSWR1, XSWG1, XSWB1 switch, corresponding to the polarity of the data signals received by the de-multiplexers 211 and 213, between the first voltage level and the zero voltage level, and the levels of the control signals XSWR2, XSWG2, XSWB2 switch, corresponding to the polarity of the data signals received by the de-multiplexers 212 and 214, between the second voltage level and the zero voltage level. As shown in FIG. 3, in the condition of displaying the N-th frame, if the de-multiplexers 211 and 213 receive the positive polarity data signals and the de-multiplexers 212 and 214 receive the negative polarity data signals, the levels of the control signals XSWR1, XSWG1, XSWB1 switch between 0 and the high voltage level AVDD (e.g., 5 V), and the levels of the control signals XSWR2, XSWG2, XSWB2 switch between the low voltage level AVEE (e.g., −5 V) and 0. Furthermore, if the de-multiplexers 211 and 213 receive the negative polarity data signals and the de-multiplexers 212 and 214 receive the positive polarity data signals, the levels of the control signals XSWR1, XSWG1, XSWB1 switch between the low voltage level AVEE (e.g., −5 V) and 0, and the levels of the control signals XSWR2, XSWG2, XSWB2 switch between 0 and the high voltage level AVDD (e.g., 5 V).

In still another embodiment, the control signals XSWR1, XSWG1, XSWB1 are synchronized with and different from the control signals XSWR2, XSWG2, XSWB2, respectively. In other words, the control signals XSWR2, XSWG2, XSWB2 are generated in synchronous with the control signals XSWR1, XSWG1, XSWB1, respectively, and the levels of the control signals XSWR2, XSWG2, XSWB2 are different from those of the control signals XSWR1, XSWG1, XSWB1 (as shown in FIG. 3).

Moreover, in one embodiment, the control signals SWR1, SWG1, SWB1 are positive-phase control signals, and the control signals XSWR1, XSWG1, XSWB1 are corresponding negative-phase control signals, and the levels of the control signals SWR1, SWG1, SWB1 are opposite to the levels of the control signals XSWR1, XSWG1, XSWB1. For example, in FIG. 3, when the levels of the control signals SWR1, SWG1, SWB1 are 0 V/5 V (or −5V/0 V), the levels of the control signals XSWR1, XSWG1, XSWB1 are 5 V/0 V (or 0 V/−5 V).

Furthermore, in another embodiment, the control signals SWR2, SWG2, SWB2 are positive-phase control signals, and the control signals XSWR2, XSWG2, XSWB2 are corresponding negative-phase control signals, and the levels of the control signals SWR2, SWG2, SWB2 are opposite to the levels of the control signals XSWR2, XSWG2, XSWB2. For example, in FIG. 3, when the levels of the control signals SWR2, SWG2, SWB2 are −5 V/0 V (or 0 V/5 V), the levels of the control signals XSWR2, XSWG2, XSWB2 are 0 V/−5 V (5 V/0 V).

Figure 4:
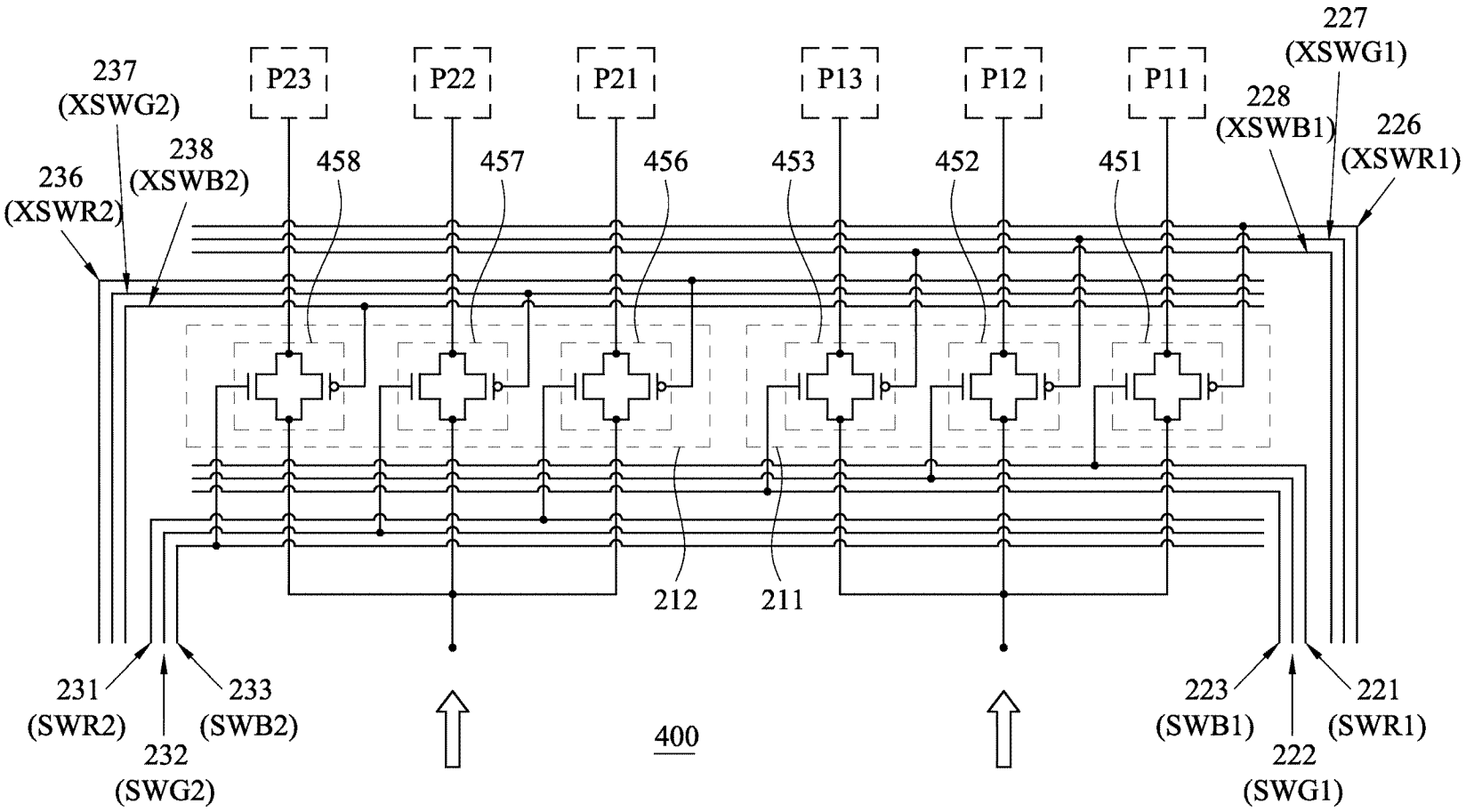
FIG. 4 is a schematic diagram of a specific circuit of the multiplexer circuit shown in FIG. 2, according to one embodiment of the present disclosure.

FIG. 4 is a schematic diagram of a specific circuit of the multiplexer circuit shown in FIG. 2, according to one embodiment of the present disclosure. As shown in FIG. 4, the de-multiplexer 211 further includes switch units 451-453, in which the switch units 451-453 are electrically coupled to the control lines 221-223, respectively, to receive the control signals SWR1, SWG1, and SWB1, and are electrically coupled to the control lines 226-228, respectively, to receive the control signals XSWR1, XSWG1, and XSWB1. The switch units 451-453 operate in accordance with the control signals SWR1, SWG1, SWB1, XSWR1, XSWG1, and XSWB1 to switch on sequentially, so as to transmit the data signals to the pixels P11, P12, and P13, respectively.

In the present embodiment, each of the switch units 451-453 may include an N-type transistor and a P-type transistor which are connected in parallel with each other (e.g., an NMOS transistor and a PMOS transistor connected in parallel, or a transmission gate), and the N-type transistor and the P-type transistor are driven by the control signals transmitted by the corresponding control lines. As shown in FIG. 4, the control terminals of the N-type transistors in the switch units 451-453 are electrically coupled to the control lines 221-223, respectively, and are driven by the control signals SWR1, SWG1, SWB1, respectively, to switch on. The control terminals of the P-type transistors in the switch units 451-453 are electrically coupled to the control lines 226-228, respectively, and are driven by the control signals XSWR1, XSWG1, XSWB1, respectively, to switch on.

Furthermore, the de-multiplexer 212 may further include switch units 456-458, in which the switch units 456-458 are electrically coupled to the control lines 231-233, respectively, to receive the control signals SWR2, SWG2, and SWB2, and are electrically coupled to the control lines 236-238, respectively, to receive the control signals XSWR2, XSWG2, and XSWB2. The switch units 456-458 operate in accordance with the control signals SWR2, SWG2, SWB2, XSWR2, XSWG2, and XSWB2 to switch on sequentially, so as to transmit the data signals to the pixels P21, P22, and P23, respectively.

Similarly, each of the switch units 456-458 may include an N-type transistor and a P-type transistor which are connected in parallel with each other (e.g., an NMOS transistor and a PMOS transistor connected in parallel, or a transmission gate), and the N-type transistor and the P-type transistor are driven by the control signals transmitted by the corresponding control lines. As shown in FIG. 4, the control terminals of the N-type transistors in the switch units 456-458 are electrically coupled to the control lines 231-233, respectively, and are driven by the control signals SWR2, SWG2, SWB2, respectively, to switch on. The control terminals of the P-type transistors in the switch units 456-458 are electrically coupled to the control lines 236-238, respectively, and are driven by the control signals XSWR2, XSWG2, XSWB2, respectively, to switch on.

Figure 5:
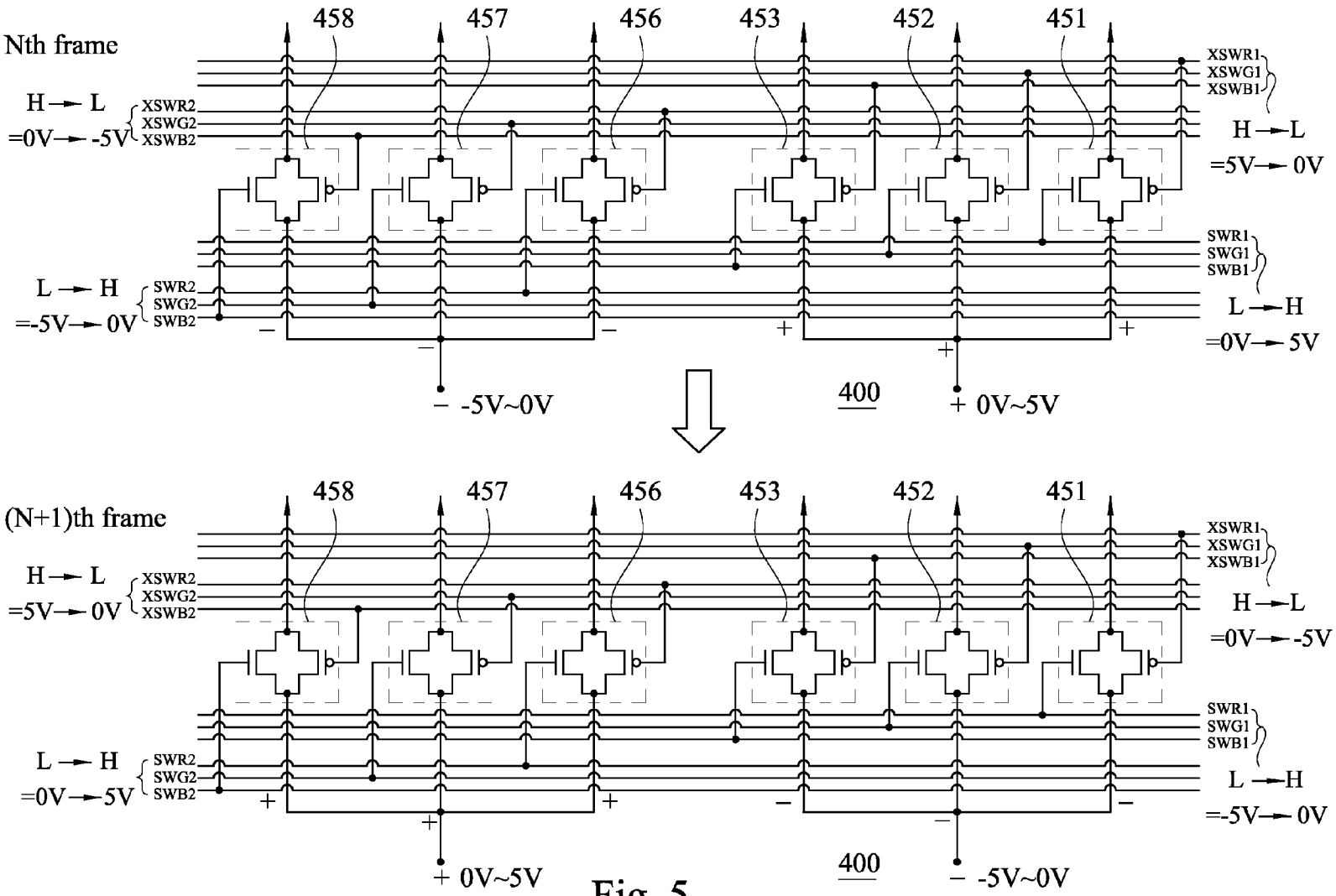
FIG. 5 is a diagram illustrating an operation of the multiplexer circuit shown in FIG. 4, according to one embodiment of the present disclosure.

FIG. 5 is a diagram illustrating an operation of the multiplexer circuit shown in FIG. 4, according to one embodiment of the present disclosure. For clear and convenient illustration, the operation shown in FIG. 5 is described with reference to the embodiment shown in FIG. 4 and a driving manner of column inversion, further in view of the control signals shown in FIG. 3, but it is not limited thereto.

In operation, in the condition of displaying the N-th frame, the switch units 451-453 receive the positive polarity data signals having levels of 0V-5 V, and the N-type transistors in the switch units 451-453 sequentially receive the control signals SWR1, SWG1, SWB1 having the levels which switch from the zero voltage level of 0 V to the positive voltage level of 5 V, to sequentially switch on, and the P-type transistors in the switch units 451-453 sequentially receive the control signals XSWR1, XSWG1, XSWB1 having the levels which switch from the positive voltage level of 5 V to the zero voltage level of 0 V, to sequentially switch on, such that the positive polarity data signals are transmitted to the corresponding pixels (e.g., three sub-pixels in one odd pixel), respectively, through the sequentially switched switch units 451-453, in which the control signals SWR1, SWG1, SWB1 are synchronized with the control signals XSWR1, XSWG1, XSWB1, respectively, and have the levels opposite to those of the control signals XSWR1, XSWG1, XSWB1.

In addition, the switch units 456-458 receive the negative polarity data signals having levels of −5V-0 V, and the N-type transistors in the switch units 456-458 sequentially receive the control signals SWR2, SWG2, SWB2 having the levels which switch from the negative voltage level of −5 V to the zero voltage level of 0 V, to sequentially switch on, and the P-type transistors in the switch units 456-458 sequentially receive the control signals XSWR2, XSWG2, XSWB2 having the levels which switch from the zero voltage level of 0 V to the negative voltage level of −5 V, to sequentially switch on, such that the negative polarity data signals are transmitted to the corresponding pixels (e.g., three sub-pixels in one even pixel), respectively, through the sequentially switched switch units 456-458, in which the control signals SWR2, SWG2, SWB2 are synchronized with the control signals XSWR2, XSWG2, XSWB2, respectively, and have the levels opposite to those of the control signals XSWR2, XSWG2, XSWB2.

On the other hand, in the condition of displaying the (N+1)-th frame, the switch units 451-453 receive the negative polarity data signals having levels of −5 V-0 V, and the N-type transistors in the switch units 451-453 sequentially receive the control signals SWR1, SWG1, SWB1 having the levels which switch from the negative voltage level of −5 V to the zero voltage level of 0 V, to sequentially switch on, and the P-type transistors in the switch units 451-453 sequentially receive the control signals XSWR1, XSWG1, XSWB1 having the levels which switch from the zero voltage level of 0 V to the negative voltage level of −5 V, to sequentially switch on, such that the negative polarity data signals are transmitted to the corresponding pixels (e.g., three sub-pixels in one odd pixel), respectively, through the sequentially switched switch units 451-453.

In addition, the switch units 456-458 receive the positive polarity data signals having levels of 0 V-5 V, and the N-type transistors in the switch units 456-458 sequentially receive the control signals SWR2, SWG2, SWB2 having the levels which switch from the zero voltage level of 0 V to the positive voltage level of 5 V, to sequentially switch on, and the P-type transistors in the switch units 456-458 sequentially receive the control signals XSWR2, XSWG2, XSWB2 having the levels which switch from the positive voltage level of 5 V to the zero voltage level of 0 V to sequentially switch on, such that the positive polarity data signals are transmitted to the corresponding pixels, respectively, through the sequentially switched switch units 456-458.

Compared to a conventional multiplexer circuit, in the multiplexer circuit of the aforementioned embodiments, the voltage variations (or voltage differences) of the alternate operation voltages required by the switch units (or the transistors therein) are relatively smaller (e.g., the voltage difference between 0 V and 5 V). As a result, when the multiplexer circuit is operated, the operation power required by the multiplexer circuit according to the aforementioned voltage variations are correspondingly reduced as well, such that the power consumption required by the display panel can be reduced significantly, and the performance of the display is significantly improved.

Figure 6:
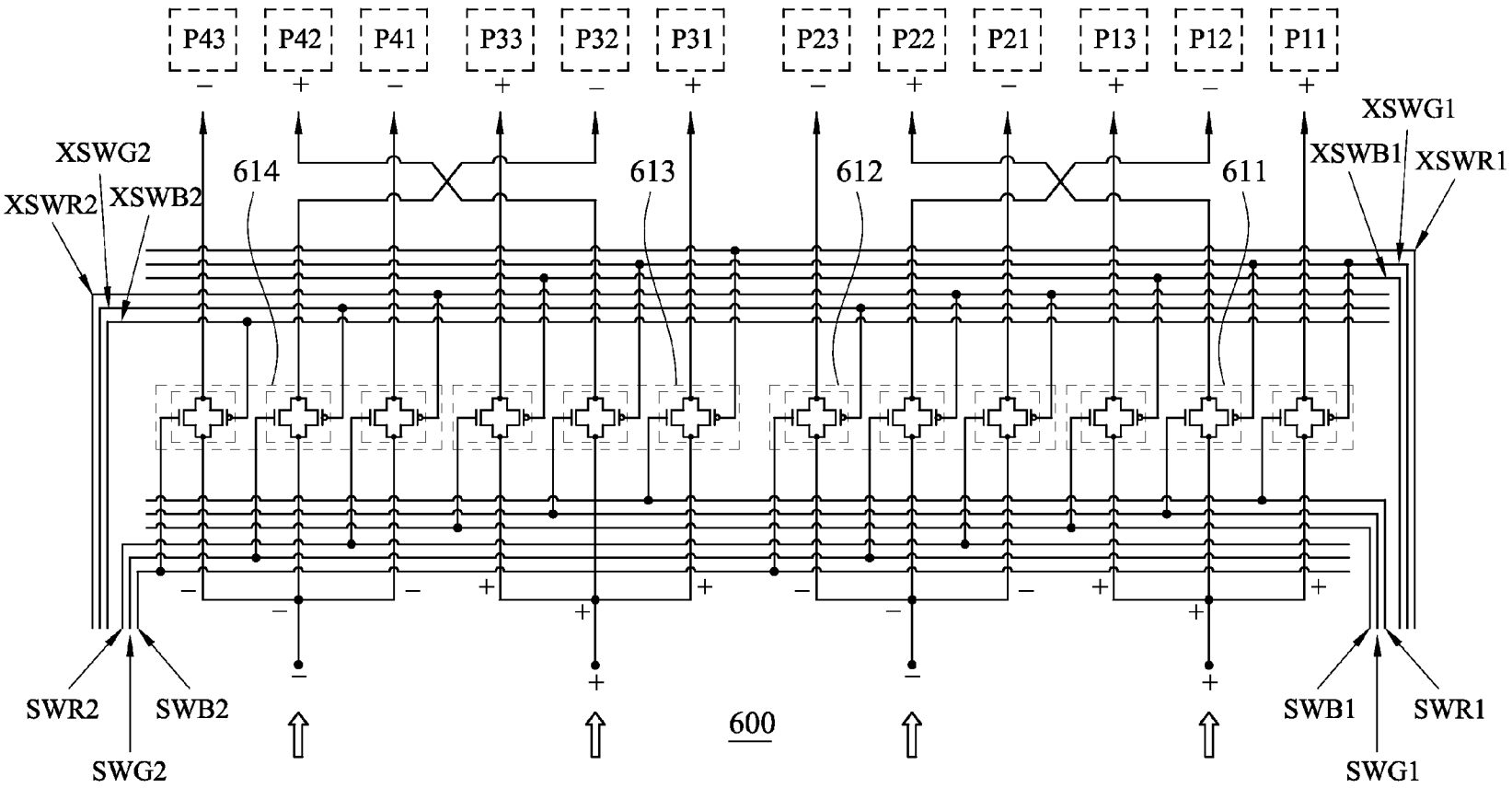
FIG. 6 is a schematic diagram of a multiplexer circuit according to a second embodiment of the present disclosure.

FIG. 6 is a schematic diagram of a multiplexer circuit according to a second embodiment of the present disclosure. The multiplexer circuit 600 shown in FIG. 6 can be applied in, but not limited to, the display 100 shown in FIG. 1. Compared to the embodiments shown in FIG. 2 or FIG. 4, in the present embodiment, the pixels coupled to the de-multiplexers 611 and 612 are arranged alternately with each other. For example, the switch units in the de-multiplexer 611 can be electrically coupled to the pixels P11, P22, and P13, and the switch units in the de-multiplexer 612 can be electrically coupled to the pixels P21, P12, and P23, such that the de-multiplexers 611 and 612 can receive the corresponding control signals to switch on, so as to alternately transmit the corresponding data signals to the corresponding pixels. Similarly, the pixels coupled to the de-multiplexers 613 and 614 are arranged alternately with each other. For example, the switch units in the de-multiplexer 613 can be electrically coupled to the pixels P31, P42, and P33, and the switch units in the de-multiplexer 612 can be electrically coupled to the pixels P41, P32, and P43, such that the de-multiplexers 613 and 614 can receive the corresponding control signals to switch on, so as to alternately transmit the corresponding data signals to the corresponding pixels.

In one embodiment, the pixels P11-P13 and P31-P33 can be sub-pixels of the odd pixels, and the pixels P21-P23 and P41-P43 can be sub-pixels of the even pixels. For example, the pixels P11-P13 (or the pixels P31-P33) may be the red (R), green (G), and blue (B) sub-pixels, respectively, in the odd pixel, and the pixels P21-P23 (or the pixels P41-P43) may be the red (R), green (G), and blue (B) sub-pixels, respectively, in the even pixel. In such condition, as shown in FIG. 6, the switch units in the de-multiplexers 611 and 613 can be driven by the corresponding control signals to switch on, so as to transmit the data signals to the sub-pixels (e.g., the pixels P11, P13, P31, P33) in the odd pixel and the sub-pixels (e.g., the pixels P22, P42) in the even pixel. Furthermore, the switch units in the de-multiplexers 612 and 614 can be driven by the corresponding control signals to switch on, so as to transmit the data signals to the sub-pixels (e.g., the pixels P12, P32) in the odd pixel and the sub-pixels (e.g., the pixels P21, P23, P41, P43) in the even pixel.

Figure 7:
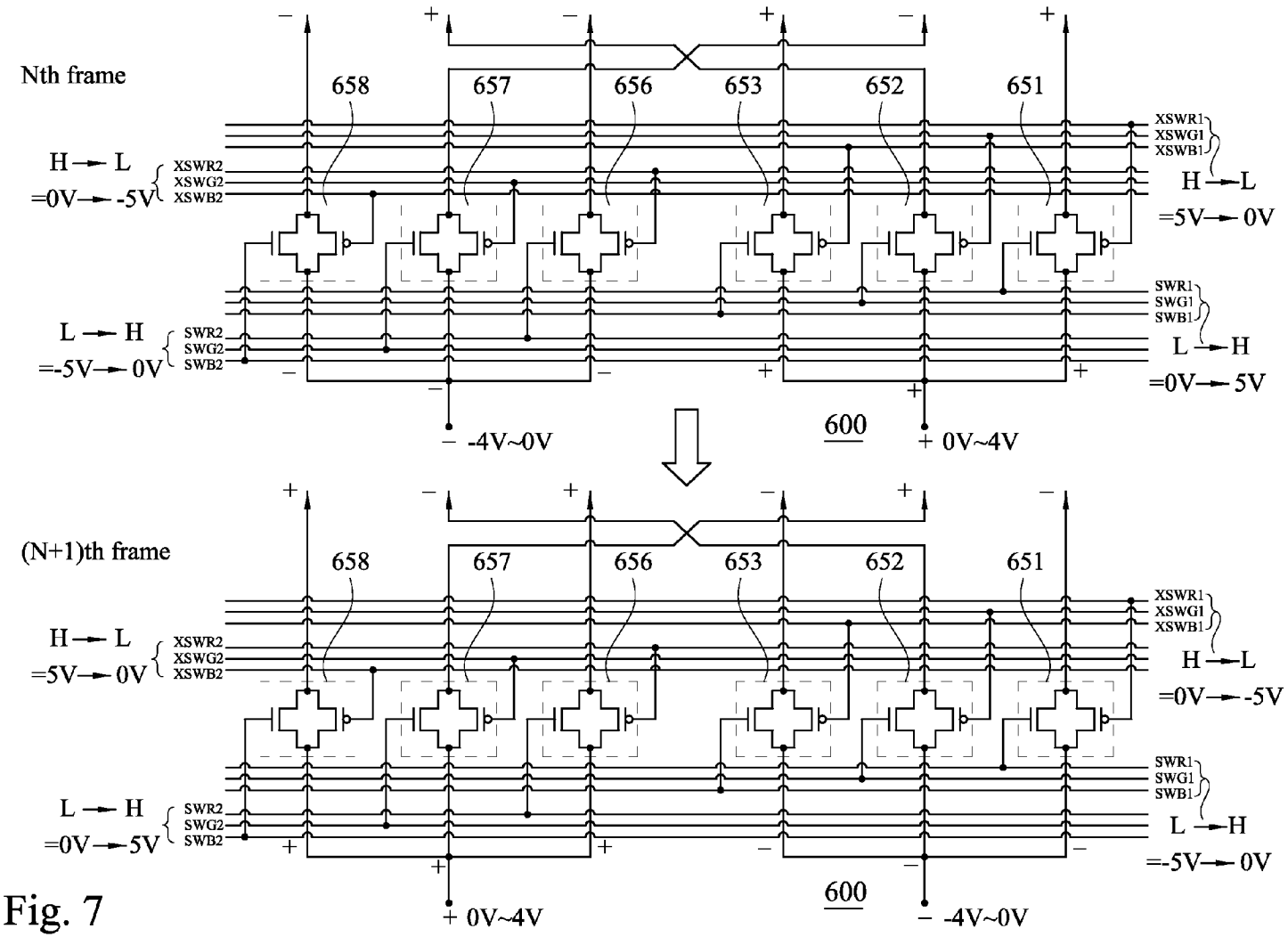
FIG. 7 is a diagram illustrating an operation of the multiplexer circuit shown in FIG. 6, according to one embodiment of the present disclosure.

FIG. 7 is a diagram illustrating an operation of the multiplexer circuit shown in FIG. 6, according to one embodiment of the present disclosure. For clear and convenient illustration, the operation shown in FIG. 6 is described with reference to the embodiment shown in FIG. 4 and a driving manner of column inversion, further in view of the control signals shown in FIG. 3, but it is not limited thereto.

In operation, in the condition of displaying the N-th frame, the switch units 651-653 receive the positive polarity data signals having levels of 0 V-4 V, and the N-type transistors in the switch units 651-653 sequentially receive the control signals SWR1, SWG1, SWB1 having the levels which switch from the zero voltage level 0 V to the positive voltage level 5 V, to sequentially switch on, and the P-type transistors in the switch units 651-653 sequentially receive the control signals XSWR1, XSWG1, XSWB1 having the levels which switch from the positive voltage level of 5 V to the zero voltage level of 0 V, to sequentially switch on, such that the positive polarity data signals are transmitted to the corresponding pixels (e.g., two sub-pixels in one odd pixel and one sub-pixel in one even pixel), respectively, through the sequentially switched switch units 651-653, in which the control signals SWR1, SWG1, SWB1 are synchronized with the control signals XSWR1, XSWG1, XSWB1, respectively, and have the levels opposite to those of the control signals XSWR1, XSWG1, XSWB1.

In addition, the switch units 656-658 receive the negative polarity data signals having levels of −4 V-0 V, and the N-type transistors in the switch units 656-658 sequentially receive the control signals SWR2, SWG2, SWB2 having the levels which switch from the negative voltage level of −5 V to the zero voltage level of 0 V, to sequentially switch on, and the P-type transistors in the switch units 656-658 sequentially receive the control signals XSWR2, XSWG2, XSWB2 having the levels which switch from the zero voltage level of 0 V to the negative voltage level of −5 V, to sequentially switch on, such that the negative polarity data signals are transmitted to the corresponding pixels (e.g., three sub-pixels in one even pixel), respectively, through the sequentially switched switch units 656-658, in which the control signals SWR2, SWG2, SWB2 are synchronized with the control signals XSWR2, XSWG2, XSWB2, respectively, and have the levels opposite to those of the control signals XSWR2, XSWG2, XSWB2.

On the other hand, in the condition of displaying the (N+1)-th frame, the switch units 651-653 receive the negative polarity data signals having levels of −4 V-0 V, and the N-type transistors in the switch units 651-653 sequentially receive the control signals SWR1, SWG1, SWB1 having the levels which switch from the negative voltage level of −5 V to the zero voltage level of 0 V, to sequentially switch on, and the P-type transistors in the switch units 651-653 sequentially receive the control signals XSWR1, XSWG1, XSWB1 having the levels which switch from the zero voltage level of 0 V to the negative voltage level of −5 V, to sequentially switch on, such that the negative polarity data signals are transmitted to the corresponding pixels, respectively, through the sequentially switched switch units 651-653.

In addition, the switch units 656-658 receive the positive polarity data signals having levels of 0 V-4 V, and the N-type transistors in the switch units 656-658 sequentially receive the control signals SWR2, SWG2, SWB2 having the levels which switch from the zero voltage level of 0 V to the positive voltage level of 5 V, to sequentially switch on, and the P-type transistors in the switch units 656-658 sequentially receive the control signals XSWR2, XSWG2, XSWB2 having the levels which switch from the positive voltage level of 5 V to the zero voltage level of 0 V to sequentially switch on, such that the positive polarity data signals are transmitted to the corresponding pixels, respectively, through the sequentially switched switch units 656-658.

Figure 8:
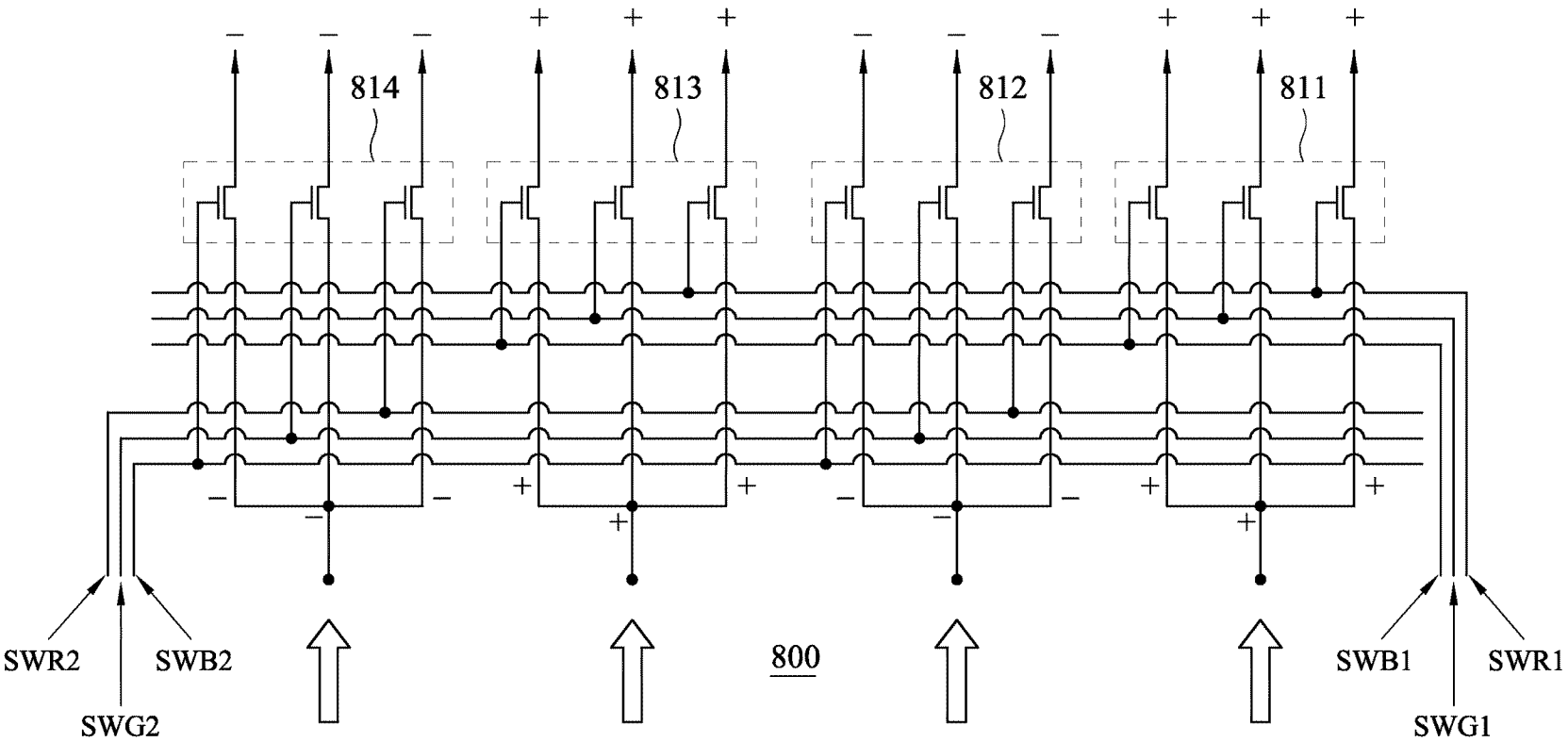
FIG. 8 is a schematic diagram of a multiplexer circuit according to a third embodiment of the present disclosure.

FIG. 8 is a schematic diagram of a multiplexer circuit according to a third embodiment of the present disclosure. Compared to the embodiments shown in FIG. 4, in the multiplexer circuit 800 of the present embodiment, the switch units in the de-multiplexers 811 and 813 include N-type transistors (e.g., NMOS transistors), and the control terminals of the N-type transistors are electrically coupled to the corresponding control lines, respectively, and are respectively driven by the control signals SWR1, SWG1, SWB1 transmitted by the corresponding control lines to switch on. Moreover, the switch units in the de-multiplexers 812 and 814 include N-type transistors (e.g., NMOS transistors), and the control terminals of the N-type transistors are electrically coupled to the corresponding control lines, respectively, and are respectively driven by the control signals SWR2, SWG2, SWB2 transmitted by the corresponding control lines to switch on.

In circuit configurations, the connections of the switch units (or the N-type transistors therein) in the de-multiplexers 811-814, the data driver, and the pixels are similar to the embodiment shown in FIG. 4, and thus they are not further detailed herein. In operation, the operations of the switch units (or the N-type transistors therein) in the de-multiplexers 811-814 are also similar to the embodiment shown in FIG. 5, and thus they are not further detailed herein.

Figure 9:
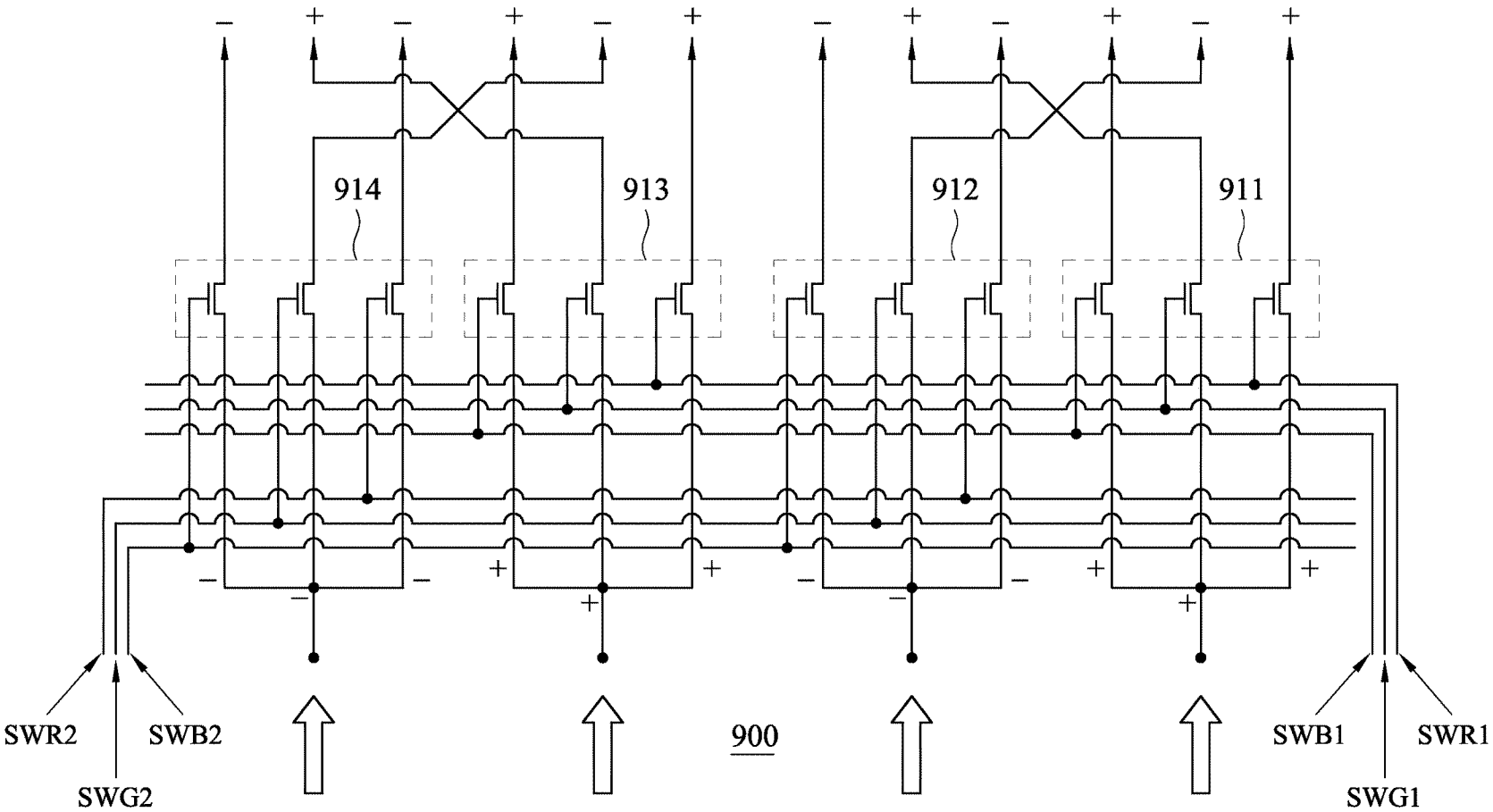
FIG. 9 is a schematic diagram of a multiplexer circuit according to a fourth embodiment of the present disclosure.

FIG. 9 is a schematic diagram of a multiplexer circuit according to a fourth embodiment of the present disclosure. Compared to the embodiments shown in FIG. 8, in the multiplexer circuit 900 of the present embodiment, the pixels coupled to the de-multiplexers 911-914 are arranged alternately with each other. Similarly, the switch units (or the N-type transistors therein) in the de-multiplexers 911 and 913 can be driven by the corresponding control signals to switch on, so as to respectively transmit the data signals to the sub-pixels in the odd pixel and the sub-pixels in the even pixel. Moreover, the switch units (or the N-type transistors therein) in the de-multiplexers 912 and 914 can be driven by the corresponding control signals to switch on, so as to respectively transmit the data signals to the sub-pixels in the odd pixel and the sub-pixels in the even pixel. In other words, the connections in FIG. 9 are similar to the embodiment shown in FIG. 6, and thus they are not further detailed herein.

In operation, the operations of the switch units (or the N-type transistors therein) in the de-multiplexers 911-914 are also similar to the embodiment shown in FIG. 7, and thus they are not further detailed herein.

Another aspect of the present disclosure is related to a method of transmitting signals in a display. The display in which the method is applied may include a plurality of first pixels, a plurality of second pixels, a plurality of first control lines, a plurality of second control lines, a first de-multiplexer and a second de-multiplexer. The first de-multiplexer further includes a plurality of first switch units, the second de-multiplexer further includes a plurality of second switch units, the first control lines are configured to transmit a plurality of first control signals, and the second control lines are configured to transmit a plurality of second control signals. For clear and convenient illustration, the method of transmitting signals in the display is described below with reference to, for example, the multiplexer circuits shown in FIG. 4, FIG. 6, FIG. 8, or FIG. 9, but it is not limited thereto.

As shown in FIG. 4, the method of transmitting signals in the display includes the following operations. The switch units 451-453 are controlled by the control signals SWR1, SWG1, SWB1, XSWR1, XSWG1, XSWB1 to switch on sequentially (or as shown in FIG. 8, the corresponding switch units are controlled by the control signals SWR1, SWG1, SWB1 to switch on sequentially). A first data signal is transmitted to the pixels P11-P13 respectively through the switch units 451-453 which are switched on sequentially. The switch units 456-458 are controlled by the control signals SWR2, SWG2, SWB2, XSWR2, XSWG2, XSWB2 to switch on sequentially (or as shown in FIG. 8, the corresponding switch units are controlled by the control signals SWR2, SWG2, SWB2 to switch on sequentially). A second data signal is transmitted to the pixels P21-P23 respectively through the switch units 456-458 which are switched on sequentially. The control signals SWR1, SWG1, SWB1, XSWR1, XSWG1, XSWB1 are synchronized with and different from the control signals SWR2, SWG2, SWB2, XSWR2, XSWG2, XSWB2, in which levels of the control signals SWR1, SWG1, SWB1, XSWR1, XSWG1, XSWB1 switch between a first voltage level and a reference voltage level corresponding to a polarity of the first data signal, and levels of the control signals SWR2, SWG2, SWB2, XSWR2, XSWG2, XSWB2 switch between a second voltage level and the reference voltage level corresponding to a polarity of the second data signal.

In one embodiment, the method of transmitting signals may further include the following operations. In a condition of the first data signal having the positive polarity and the second data signal having the negative polarity, the levels of the control signals SWR1, SWG1, SWB1 are switched from the zero voltage level to the positive voltage level, and the levels of the control signals XSWR1, XSWG1, XSWB1 are switched from the positive voltage level to the zero voltage level (or as described in the embodiment shown in FIG. 8, only the levels of the control signals SWR1, SWG1, SWB1 are switched from the zero voltage level to the positive voltage level), for controlling the corresponding switch units to switch on sequentially. Moreover, the levels of the control signals SWR2, SWG2, SWB2 are switched from the negative voltage level to the zero voltage level, and the levels of the control signals XSWR2, XSWG2, XSWB2 are switched from the zero voltage level to the negative voltage level (or as described in the embodiment shown in FIG. 8, only the levels of the control signals SWR1, SWG1, SWB1 are switched from the negative voltage level to the zero voltage level), for controlling the corresponding switch units to switch on sequentially.

In another embodiment, the method of transmitting signals may further include the following operations. In a condition of the first data signal having the negative polarity and the second data signal having the positive polarity, the levels of the control signals SWR1, SWG1, SWB1 are switched from the negative voltage level to the zero voltage level, and the levels of the control signals XSWR1, XSWG1, XSWB1 are switched from the zero voltage level to the negative voltage level (or as described in the embodiment shown in FIG. 8, only the levels of the control signals SWR1, SWG1, SWB1 are switched from the negative voltage level to the zero voltage level), for controlling the corresponding switch units to switch on sequentially. Moreover, the levels of the control signals SWR2, SWG2, SWB2 are switched from the zero voltage level to the positive voltage level, and the levels of the control signals XSWR2, XSWG2, XSWB2 are switched from the positive voltage level to the zero voltage level (or as described in the embodiment shown in FIG. 8, only the levels of the control signals SWR1, SWG1, SWB1 are switched from the zero voltage level to the positive voltage level), for controlling the corresponding switch units to switch on sequentially.

In still another embodiment, as shown in FIG. 6, the pixels P11-P13 and P31-P33 can be the sub-pixels of the odd pixels, the pixels P21-P23 and P41-P43 can be the sub-pixels of the even pixels, and the method of transmitting signals may further include the following operations. The first data signal is transmitted to at least one sub-pixel (e.g., the pixels P11, P13, P31, P33) in the odd pixels and at least one sub-pixel (e.g., the pixels P22, P42) in the even pixels respectively through the sequentially switched switch units in the de-multiplexers 611 and 613. The second data signal is transmitted to at least one sub-pixel (e.g., the pixels P12, P32) in the odd pixels and at least one sub-pixel (e.g., the pixels P21, P23, P41, P43) in the even pixels respectively through the sequentially switched switch units in the de-multiplexers 612 and 614.

The steps are not necessarily recited in the sequence in which the steps are performed. That is, unless the sequence of the steps is expressly indicated, the sequence of the steps is interchangeable, and all or part of the steps may be simultaneously, partially simultaneously, or sequentially performed.

As illustrated in the aforementioned embodiments, the display and the method of transmitting signals in the display can be applied not only to reduce the operation voltage required by the multiplexer circuit in the display but also to effectively reduce power consumption required by the multiplexer circuit, such that the power consumption required by the display panel can be reduced significantly as well, and the power required by the display can be reduced.

As is understood by a person skilled in the art, the foregoing embodiments of the present disclosure are illustrative of the present disclosure rather than limiting of the present disclosure. It is intended to cover various modifications and similar arrangements included within the spirit and scope of the appended claims, the scope of which should be accorded with the broadest interpretation so as to encompass all such modifications and similar structures.

What is claimed is:

1. A display comprising:

a plurality of first control lines;

a plurality of first de-multiplexers, each of the plurality of first de-multiplexers electrically coupled to the first control lines and configured to receive a plurality of first control signals through the first control lines to sequentially transmit a first data signal received by each of the plurality of first de-multiplexers to a plurality of first pixels electrically coupled to each of the plurality of first de-multiplexers in response to the first control signals;

a plurality of second control lines; and a plurality of second de-multiplexers, each of the plurality of second de-multiplexers electrically coupled to the second control lines and configured to receive a plurality of second control signals through the second control lines to sequentially transmit a second data signal received by each of the plurality of second de-multiplexers to a plurality of second pixels electrically coupled to each of the plurality of second de-multiplexers in response to the second control signals;

wherein a polarity of the first data signal is different from a polarity of the second data signal, each of the plurality of first de-multiplexers further comprises a plurality of first switch units, each of the plurality of second de-multiplexers further comprises a plurality of second switch units, each of the plurality of first switch units, which is controlled by one of the first control lines, is configured to transmit the first data signal synchronized with at least one of the plurality of second switch units transmitting the second data signal, which is controlled by one of the second control lines different from the first control lines, and each of the plurality of first control lines is configured to control only the first de-multiplexers receiving data signals with an identical polarity at a same time;

wherein levels of the first control signals switch, corresponding to the polarity of the first data signal, between a first voltage level and a zero voltage level, and levels of the second control signals switch, corresponding to the polarity of the second data signal, between a second voltage level and the zero voltage level, wherein a polarity of the first voltage level is different from a polarity of the second voltage level; and wherein the first switch units and the second switch units comprise insulated-gate field effect transistors respectively.

2. The display as claimed in claim 1, wherein the first switch units are configured to receive the first control signals to switch on sequentially to transmit the first data signal to the first pixels respectively, and the second switch units are configured to receive the second control signals to switch on sequentially to transmit the second data signal to the second pixels respectively.

3. The display as claimed in claim 2, wherein each of the plurality of first switch units comprises an N-type transistor and a P-type transistor which are connected in parallel with each other.

4. The display as claimed in claim 3, wherein the first control signals comprises a first positive-phase control signal and a first negative-phase control signal separately configured to drive the N-type transistors and the P-type transistors, wherein levels of the first positive-phase control signal and the first negative-phase control signal are opposite, wherein the first positive-phase control signal switches between the first voltage level and the zero voltage level.

5. The display as claimed in claim 2, wherein the first pixels and the second pixels are arranged alternately with each other.

6. The display as claimed in claim 1, wherein each one of active periods of the plurality of first control signals are synchronized with one of active periods of the plurality of second control signals, and each one of the plurality of first control signals has a polarity different from the second control signal to which the first control signal synchronized during the active period of the first control signal.

7. The display as claimed in claim 1, wherein a polarity of the first control signals is the same as the polarity of the first data signal, a polarity of the second control signals is the same as the polarity of the second data signal.

8. The display as claimed in claim 1, wherein the first control signals comprises a first positive-phase control signal and a first negative-phase control signal separately configured to drive N-type transistors and P-type transistors of the first switch units, wherein a level of the first positive-phase control signal is opposite to a level of the first negative-phase control signal, wherein the first positive-phase control signal switches between the first voltage level and the zero voltage level.

9. The display as claimed in claim 1, wherein in a condition of the first data signal or the second data signal having a positive polarity, the first control signals or the second control signals have low levels of zero voltage, and in a condition of the first data signal or the second data signal having a negative polarity, the first control signals or the second control signals have high levels of zero voltage.

10. A display comprising:

a plurality of first pixels;

a plurality of second pixels;

a first de-multiplexer electrically coupled to the first pixels and configured to operate in response to a plurality of first control signals received by the first de-multiplexer to transmit a first data signal received by the first de-multiplexer to the first pixels sequentially; and a second de-multiplexer electrically coupled to the second pixels and configured to operate in response to a plurality of second control signals received by the second de-multiplexer to transmit a second data signal received by the second de-multiplexer to the second pixels sequentially;

wherein a polarity of the first data signal is different from a polarity of the second data signal, levels of the first control signals switch, corresponding to the polarity of the first data signal, between a first voltage level and a zero voltage level, levels of the second control signals switch, corresponding to the polarity of the second data signal, between a second voltage level and the zero voltage level, and a polarity of the first voltage level is different from a polarity of the second voltage level;

wherein each one of active periods of the plurality of first control signals are synchronized with one of active periods of the plurality of second control signals, and each one of the plurality of first control signals has a polarity different from the second control signal to which the first control signal synchronized during the active period of the first control signal, wherein the first de-multiplexer and the second de-multiplexer comprise insulated-gate field effect transistors respectively.

11. The display as claimed in claim 10, wherein the first de-multiplexer further comprises a plurality of first switch units, and the second de-multiplexer further comprises a plurality of second switch units;

wherein the first switch units are configured to receive the first control signals to switch on sequentially to transmit the first data signal to the first pixels, respectively, and the second switch units are configured to receive the second control signals to switch on sequentially to transmit the second data signal to the second pixels, respectively.

12. The display as claimed in claim 11, wherein the first pixels and the second pixels are arranged alternately with each other.

13. The display as claimed in claim 12, wherein each of the plurality of first switch units comprises an N-type transistor, and the corresponding first control signal is received via a gate terminal of the N-type transistor.

14. The display as claimed in claim 11, wherein each of the plurality of first switch units comprises an N-type transistor and a P-type transistor which are connected in parallel with each other.

15. The display as claimed in claim 14, wherein the first control signals comprises a first positive-phase control signal and a first negative-phase control signal separately configured to drive the N-type transistors and the P-type transistors, wherein a level of the first positive-phase control signal is opposite to a level of the first negative-phase control signal, wherein the first positive-phase control signal switches between the first voltage level and the zero voltage level.

16. The display of claim 10, wherein the first de-multiplexer is electrically coupled to a plurality of first control lines to receive the first control signals, and the second de-multiplexer is electrically coupled to a plurality of second control lines to receive the second control signals, and each of the plurality of first control lines is configured to control only the first de-multiplexer receiving the first data signal with an identical polarity at a same time.

17. A method of transmitting signals in a display, the display comprising a plurality of first pixels, a plurality of second pixels, a plurality of first control lines, a plurality of second control lines, a first de-multiplexer and a second de-multiplexer, wherein the first de-multiplexer further comprises a plurality of first switch units, the second de-multiplexer further comprises a plurality of second switch units, the first switch units and the second switch units comprise insulated-gate field effect transistors, the first control lines are configured to transmit a plurality of first control signals, and the second control lines are configured to transmit a plurality of second control signals, the method comprising:

controlling the first switch units to switch on sequentially by the first control signals;

transmitting a first data signal to the first pixels respectively through the first switch units which are switched on sequentially;

controlling the second switch units to switch on sequentially by the second control signals; and transmitting a second data signal to the second pixels respectively through the second switch units which are switched on sequentially;

wherein the first control signals and the second control signals are synchronized and different from each other, levels of the first control signals switch between a first voltage level and a reference voltage level corresponding to a polarity of the first data signal, and levels of the second control signals switch between a second voltage level and the reference voltage level corresponding to a polarity of the second data signal, and the polarity of the first data signal is different from the polarity of the second data signal;

wherein transmitting the first data signal to the first pixels respectively through the first switch units comprises transmitting the first data signal through one of the first switch units, which is controlled by one of the first control lines, and transmitting the second data signal to the second pixels respectively through the second switch units comprises transmitting the second data signal through one of the second switch units, which is controlled by one of the second control lines different from the first control lines, synchronized with the step of transmitting the first data signal through one of the first switch units.

18. The method as claimed in claim 17, further comprising:

in a condition of the first data signal having a positive polarity and the second data signal having a negative polarity, switching the levels of the first control signals from a zero voltage level to a positive voltage level for controlling the first switch units to switch on sequentially, and switching the levels of the second control signals from a negative voltage level to the zero voltage level for controlling the second switch units to switch on sequentially.

19. The method as claimed in claim 17, further comprising:

in a condition of the first data signal having a negative polarity and the second data signal having a positive polarity, switching the levels of the first control signals from a negative voltage level to a zero voltage level for controlling the first switch units to switch on sequentially, and switching the levels of the second control signals from the zero voltage level to a positive voltage level for controlling the second switch units to switch on sequentially.

20. The method as claimed in claim 17, further comprising:

transmitting the first data signal to at least one of the first pixels and at least one of the second pixels respectively through the first switch units which are switched on sequentially; and transmitting the second data signal to at least one of the first pixels and at least one of the second pixels respectively through the second switch units which are switched on sequentially.

* * * * *